United States Patent [19]

Justus

[11] 4,141,788

[45] Feb. 27, 1979

[54] METHOD OF AND MEANS FOR FORMING MULTI-PLY PAPER WEBS FROM A SINGLE HEADBOX

[75] Inventor: Edgar J. Justus, Beloit, Wis.

[73] Assignee: Beloit Corporation, Beloit, Wis.

[21] Appl. No.: 902,116

[22] Filed: May 2, 1978

[51] Int. Cl.[2] ..... D21F 1/02; D21H 1/06

[52] U.S. Cl. ..... 162/125; 162/132; 162/203; 162/216; 162/301; 162/343; 162/347

[58] Field of Search ..... 162/123, 125, 126, 132, 162/203, 216, 301, 303, 336, 343, 344, 347

[56] References Cited

U.S. PATENT DOCUMENTS

| | | | |
|---|---|---|---|
| 2,693,739 | 11/1954 | Okawa et al. | 162/203 X |
| 3,598,696 | 8/1971 | Beck | 162/343 X |
| 3,802,960 | 4/1974 | Spengos et al. | 162/216 |
| 3,843,470 | 10/1974 | Betley et al. | 162/343 |
| 3,923,593 | 12/1975 | Verseput | 162/301 |

*Primary Examiner*—Richard V. Fisher

*Attorney, Agent, or Firm*—Hill, Gross, Simpson, Van Santen, Steadman, Chiara & Simpson

[57] ABSTRACT

Multi-ply web forming stock jets directed through a slice from a single headbox into a forming zone between converging forming surfaces in a papermaking machine are maintained separated for a sufficient interval after leaving the slice opening to permit drainage and partial ply formation of the stock delivered by one of the stock jets to one of the forming surfaces before the stock in a second of the stock jets joins in fiber felting laminar relation with the contiguous surface of the partially formed ply. Flexible divider sheet members divide the slice chamber of a headbox into separate flow passages aligned respectively with different ones of headbox subchambers to receive streams of the stock from the respective subchambers and maintain the streams separated, and the flexible members extend a substantial distance out of the slice opening in the direction of flow of the stock jets to maintain stock jets separated for a sufficient interval after leaving the slice opening.

16 Claims, 2 Drawing Figures

METHOD OF AND MEANS FOR FORMING MULTI-PLY PAPER WEBS FROM A SINGLE HEADBOX

Figure 1:
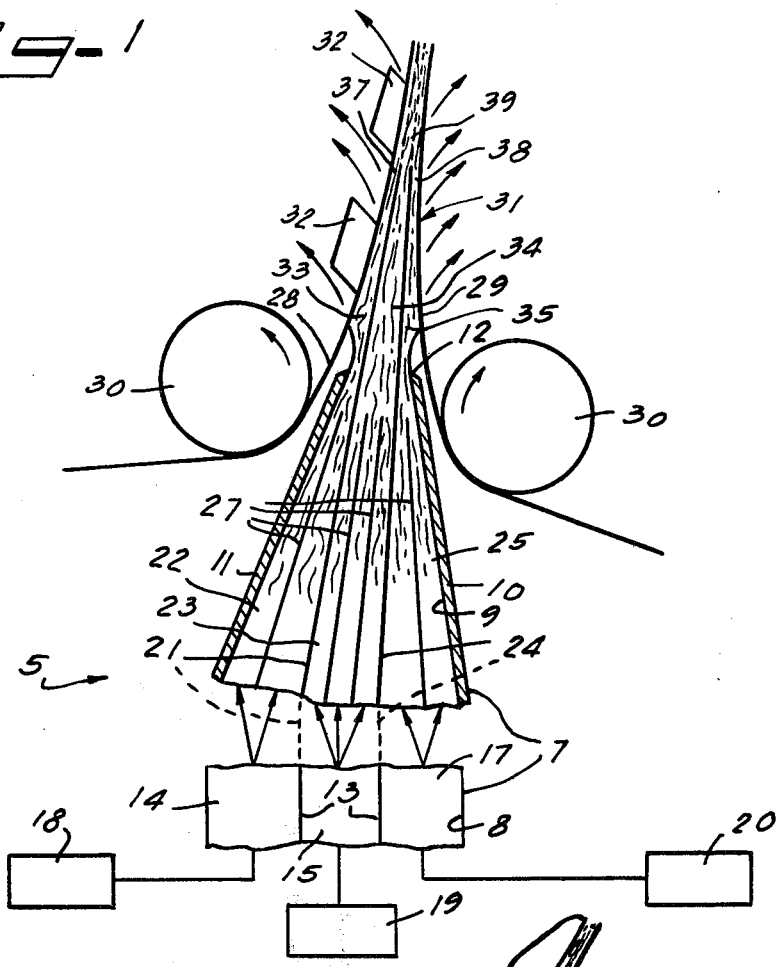

This invention relates to improvements in methods of and means for forming multi-ply paper webs from a single headbox. More particularly, the present invention is an improvement upon the disclosure in U.S. Pat. No. 3,923,593 relating to a high speed multi-ply paper web forming arrangement, and to the extent necessary, and in order to reduce the present disclosure to the bare essentials, the disclosure of said patent is incorporated herein by reference.

As pointed out in said prior patent, in the formation of multi-ply webs, increases in machines speeds and increases in requirements of stock specifications have created operating problems in that the demand for improved high quality paper webs has been accelerating, and competitive considerations have encouraged higher manufacturing speeds of the papermaking machines. According to the technique disclosed in said prior patent, a plurality of different stocks of different physical characteristics are delivered from a slice to the forming area between twin forming surface wires while at the same time maintaining the different stocks generally in their multi-ply layer arrangement between flexible divider sheets in the slice chamber, the divider sheets terminating short of the slice opening. Fine scale turbulence is relied upon within each of the stocks to prevent flocculation, but the turbulence generating means terminate substantially upstream from the slice opening so as to substantially avoid carry-over of the turbulence and undesirable intermixture of the stock for the plies on the wire, while nevertheless permitting interlocking of the fibers between plies.

The aforesaid arrangement has functioned reasonably well to prevent fiber intermixing at moderate speeds and where turbulence levels have been maintained sufficiently low in the delivery jet from the slice opening. However, the demand for higher speed operation, and corresponding increased jet velocity from the slice aggravates a tendency for the different stocks to intermix undesirably after leaving the flexible flow passage dividers in the slice chamber.

A principal reason for multi-ply paper webs is to provide one or more surface layers on the resulting sheet having particular desirable characteristics, such, for example, as finer grade for ink receptivity in printing, or to provide an ash barrier where a high ash content intermediate layer is surfaced by long fiber stock to prevent draining of ash during the dewatering of the forming web, and the like. As slice jet velocity increases, maintaining of the necessary integrity in the stocks forming the respective multi-ply layers becomes more and more difficult.

An important object of the present invention is to overcome the problem of maintaining ply integrity in forming multi-ply paper webs at high speed in machines employing a single headbox delivering a plurality of different stock fiber suspensions to a multi-ply web forming zone.

Another object of the invention is to provide a new and improved method of and means for forming multi-ply paper web in a single headbox papermaking machine in a manner to maintain excellent ply integrity but with thorough interlocking of fibers at the interface between plies for securing the plies to an integral web.

According to features of the invention, there is provided a method useful in a machine for making multi-ply web such as a paper from stocks having a slurry of fibers in a liquid carrier and having a headbox provided with a main chamber communicating with a slice chamber defined by spaced walls leading to a slice opening, and which comprises delivering stocks which may have different physical characteristics to each of a plurality of subchambers into which the main chamber of the headbox is divided, dividing the slice chamber into separate flow passages between a flexible self-positionable divider sheet and aligned respectively with different ones of the headbox subchambers, receiving streams of the stocks from the respective subchambers in said flow passages, maintaining the stock streams separated in the flow passages, discharging the streams in contiguous substantially laminar stock jets from the slice opening into a forming zone between convergently co-travelling forming surfaces, and maintaining the stock jets separated between a flexible free floating extension from said divider sheet extending a substantial distance out of said slice opening in the direction of flow of the stock jets for an interval sufficient to permit drainage and partial formation into a ply of the stock delivered by one of the stock jets onto one of the forming surfaces before the stock in a second of the stock jets joins in fiber felting multi-ply laminar relation with the contiguous surface of the partially formed ply.

According to other features of the invention, there is provided for use in a machine for making multi-ply webs such as a paper from stocks having a slurry of fibers in a liquid carrier, a headbox having a main chamber communicating with a slice chamber defined by spaced walls leading to a slice opening, means dividing the main chamber into a plurality of separate stock subchambers, separate stock supply means for delivering stocks which may have different physical characteristics to each of said subchambers, at least one flexible self-positionable divider sheet in the slice chamber dividing the slice chamber into separate flow passages aligned respectively with different ones of said headbox main chamber subchambers to receive streams of the stock from the respective subchambers and maintain the streams separated, said flow passages leading to said slice opening for discharging the streams in contiguous substantially laminar stock jets from the slice opening into a forming zone between convergently co-travelling forming surfaces, and a flexible divider extension extending from said divider sheet in free floating relation a substantial distance out of said slice opening in the direction of flow of the stock jets whereby to maintain the stock jets separated for a sufficient interval after leaving the slice opening to permit drainage and partial formation into a ply of the stock delivered by one of the stock jets onto one of the forming surfaces before the stock in a second of the stock jets joins in fiber felting multi-ply laminar relation with the contiguous surface of the partially formed ply.

Other objects, features and advantages of the invention will be readily apparent from the following description of certain representative emobdiments thereof, taken in conjunction with the accompanying drawing although variations and modifications may be effected without departing from the spirit and scope of the novel concepts embodied in the disclosure and in which:

DRAWINGS

Figure 2:
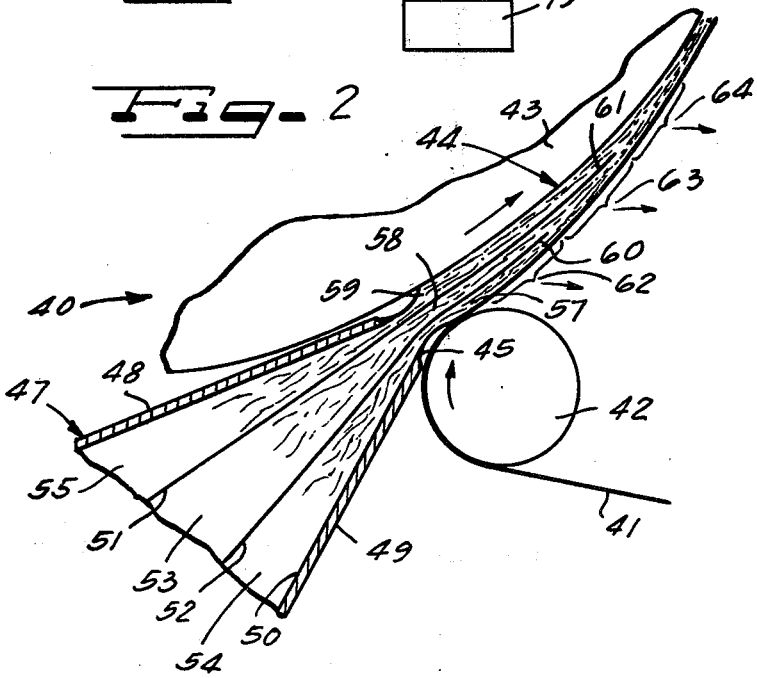

FIG. 1 is a schematic illustration demonstrating one preferred form of the invention; and FIG. 2 is a schematic illustration demonstrating a modified form of the invention.

DESCRIPTION

According to the principles of the present invention, any preferred number of plies may be formed advantageously in the course of making a multi-ply paper web, from a two-ply web to as many plies as desirable. Commonly no more than three plies are necessary. For example, where it is desired to produce paper having differently colored opposite sides such as white on one side and brown on the other, the paper slurry stocks may be selected to supply white fibers in one ply and brown fibers in the second ply. A three-ply web may be produced to provide a paper sheet or paper board having a cheaper grade of stock surfaced by higher grade stock, or where, for example, the paper web has an intermediate high ash content layer and opposite or outer layers of long fibered stock, and the like.

FIG. 1 illustrates schematically as much as needed for the present purposes, a papermaking machine 5 adapted for producing a three-ply paper web by means of a single headbox 7. Within the headbox 7 a main chamber 8 communicates with a slice chamber 9 defined by converging spaced walls 10 and 11 which lead to a slice opening 12. Means comprising partitions 13 divide the main chamber 8 into a plurality of separate stock subchambers 14, 15 and 17 wherein the subchamber 15 is intermediate the chambers 14 and 17. Separate stock supply means for delivering stocks which may have different physical characteristics to each of the subchambers comprise a delivery means 18 communicating with the subchamber 14, a delivery means 19 communicating with the subchamber 15 and a delivery means 20 communicating with the subchamber 17. It will be appreciated, of course, that each of the delivery means 18, 19 and 20 will have communication with a suitable stock source and will supply the stock to the associated headbox subchamber at the proper consistency and under adequate pressure to produce the desired stock flow velocity for high speed operation.

Within the slice chamber 9, streams of the stock from the respective subchambers 14, 15 and 17 are received in separate flow passages aligned respectively with the different ones of the subchambers. For this purpose, divider means such as a flexible divider sheet member 21 in alignment with the divider 13 separating the subchambers 14 and 15 extends longitudinally through the slice chamber 9 and divides a flow passage 22 aligned with the subchamber 14 from a flow passage 23 aligned with the subchamber 15. To the same effect, a flexible divider sheet member 24 is aligned with the divider 13 which separates the subchamber 15 from the subchamber 17 and extends longitudinally through the slice chamber 9, separating the passage 23 from a flow passage 25 aligned with the subchamber 17. The divider members 21 and 24 may be made from any suitable sheet material such as a plastic material of adequate quality and weight for the purpose. Preferably the divider members 21 and 24 are secured fixedly at their upstream ends within the headbox structure while throughout the remainder of their length they may be unsupported and self-positionable by virtue of the hydraulic forces of the stock flowing through the slice chamber. The floating members 21 and 24 also maintain a fine scale turbulence within the stock in the subchambers 15 and 17. Within each of the passages 22, 23 and 25, means additional to the flexible sheets 21 and 24 comprise self-positionable elements 27 which may be flexible sheet members made from material on the order of that from which the divider members 21 and 24 are made; or the turbulence generators may be strand-like elements. In any event, the turbulence generator members 27 are secured fixedly at their upstream ends within the headbox and are free in the downstream direction. By preference, the turbulence generators 27 extends short of the slice opening 12. Each of the divider members 21 and 24, at least, extends across the full width of the slice chamber 9 so as to maintain continuous separation between the flow passages whereby to maintain substantial integrity of the stocks flowing through the passages. From the slice opening 12, the stock from the slice chamber 9 is delivered into a forming zone between co-travelling forming surfaces 28 and 29 which, in FIG. 1, comprise means such as endless forming wires partially wrapping respective breast rolls 30 from which the forming surface wires generally converge past the slice opening 12 and define a forming zone 31 receptive of the stock delivered from the slice opening. Along the forming zone either or both of the porous forming surfaces 28 and 29 may be equipped with drainage promoting foils 32 or other desirable drainage promoting means.

Velocity of the streams of stock delivered from the slice chamber passages through the slice opening 12 effects a substantially jet propulsion, that is a stock jet 33 from the passage 22, a stock jet 34 from the intermediate passage 23 and a stock jet 35 from the passage 25.

Normally, the tendency of the jet streams 33, 34 and 35 would be to substantially commingle to at least a substantial depth at their interfaces so that the intermediate stock jet 34 may substantially lose integrity of its stock content by admixture with the stock content of the stock jets 33 and 35. Further, the result may be to contaminate the outer stock jets 33 and 35 with undesired stock fiber or other material such as ash or the like from the intermediate stock jet 34 to the extent that the forming surfaces of the web plies at the forming surfaces 28 and 29 may be undesirably affected. To the alleviation of this problem, the stock jets 33, 34 and 35 are, according to the present invention, maintained separate beyond the slice opening 12 long enough to permit sufficient drainage of the fiber suspension delivered in the outer jets 33 and 35 to reduce the mobility of the fibers in the plies formed by the stock in the outer jets before the intermediate stock jet fiber suspension joins with the partially formed outer plies. Efficient means for this purpose comprise extending the downstream ends of the divider members 21 and 24 to project beyond the slice opening 12 into the forming zone 31 a sufficient distance, depending upon various factors such as types of fiber suspensions, velocity, speed of the web former, and the like, to provide free floating divider extensions which maintain the intermediate stock jet 34 substantially separated from both of the outer stock jets 33 and 35 to permit drainage as indicated by directional arrows and partial forming of respective web plies 37 and 38 before the stock jet 34 enters between the partially formed plies 37 and 38 to form an intermediate ply 39. As thus joined to the partially formed plies 37 and 38, there is still sufficient looseness in the fibers at the interfaces of the forming outer plies 37 and 38 to interlock with and effect a satisfactory felted bond with the stock in the forming inner ply 39 which drains through the partially formed outer plies 37 and 38. However, the depth of commingling of the inner ply stock with the outer ply stock is efficiently limited by reason of the substantial decrease in mobility of the stocks in the partially formed outer plies. In a preferred arrangement, as shown, the extension from the divider members 21 and 24 may extend an equal distance beyond the slice opening 12. To accommodate conditions where contact between the intermediate ply stock jet with either of the outer ply stock jets should be effected sooner than contact between the inner ply stock jet and the remaining outer ply stock jet, then a suitable differential in length of projection of the divider members may be effected.

The invention is also advantageous for high speed operation of a single headbox multi-ply web papermaking machine 40 (FIG. 2) of the type known as a roll former. In such a machine, converging web forming surfaces are provided by an endless porous forming member 41 such as a foraminous wire belt which wraps around a breast roll 42 and runs convergently toward the perimeter of a larger diameter forming roll 43 running in the same direction. This arrangement provides a gradually diminishing forming zone 44 into the mouth of which a slice opening 45 of a headbox 47 delivers a plurality of separate stock supplies. Similarly, as in FIG. 1, the headbox has a pair of convergently related walls 48 and 49 defining a slice chamber 50 terminating in the slice opening 45. Division of the slice chamber 50 into separate flow passages aligned respectively with different ones of subchambers in a main chamber of the headbox 47, similarly as described in FIG. 1, to receive streams of the stock from the respective subchambers and maintain the streams separated, is effected by means comprising at least one divider where a two-ply web is to be formed, but, as shown, where a three-ply web is to be formed respective dividers 51 and 52 separating the slice chamber 50 into an intermediate ply flow passage 53 and respective outer ply flow passages 54 and 55. Each of the dividers 51 and 52 may be formed from suitable sheet plastic material, similarly as described for the dividers in FIG. 1. Suitable turbulence generating means such as sheets or strands as indicated in FIG. 1, may be mounted in the flow passages 53, 54 and 55, or any other preferred type of turbulence generator may be employed as desired. By means of the dividers 51 and 52, the flow passages are controlled to discharge the streams from the flow passages in contiguous substantially laminar stock jets from the slice opening 45 into the forming zone 44, the stock from the flow passage 54 discharging as a jet 57, the stock from the intermediate stream 53 discharging as a jet 58, and the stock discharging from the stream 55 forming a jet 59.

In order to maintain the contiguous substantially laminar stock jets 57, 58 and 59 separated for a sufficient interval after leaving the slice opening 45 to permit drainage and partial formation into a ply of the stock delivered by at least one of the stock jets to one of the forming surfaces before the stock in a second of the stock jets joins in fiber felting multi-ply laminar relation with the contiguous surface of the partially formed ply, divider extension means are provided comprising integral extensions from the dividers 51 and 52, comprising an extension 60 from the divider 52 and an extension 61 from the divider 51, such extensions extending from the dividers a substantial distance out of the slice opening 45 in the direction of flow of the stock jets. Since, in the roll former arrangement disclosed, liquid drainage from the paper-making stock in the forming zone 44 is through the porous forming surface 41, as indicated by the directional arrows in FIG. 2, and the stock jet 57 is the nearest to and engages the forming surface 41, the divider extension 61 extends from the slice opening 45 a sufficient distance to assure adequate separation of the intermediate jet 58 from the jet 57 during the initial dewatering of the stock in the jet 57 to avoid contact between the jets 57 and 58 until dewatering of the stock in the jet 57 has progressed for an interval of advance with the travelling forming surface 41, as indicated by the brace 62 for a sufficient distance to reduce the mobility of fibers in the developing ply of stock on the forming surface 41 to avoid undesirable intermingling of the stock in the jet 58 upon engagement with the stock from the jet 57, but with still sufficient looseness of the fibers at the interface between the forming, less mobile stock from the jet 57 and the still highly mobile and substantially turbulent stock in the jet 58. For this purpose the divider extension 60 terminates at the end of the extent indicated by the brace 62. The stock in the jet 58 then engages upon the partially formed web ply from the jet 57, immediately beyond the end of the divider extension 60, and drainage through the partially formed jet 57 ply effects partial formation of the jet 58 ply. Such ply on ply formation occurs throughout a suitable length indicated by the brace 63 while the divider extension 61 maintains the jet 59 separated from the forming jet 58 ply. The length of the divider extension 61 is just sufficiently longer than the length of the divider extension 60 to attain partial formation of the jet 58 ply so that upon joining of the jet 59 with such partially formed ply, there will be adequate fiber felting at the interfaces without undesirable depth commingling of the fibers in the jet 59 with the fibers in the jet 58 ply. As a result, as the preliminary drainage of liquid from the jet 59 ply progresses as indicated by the brace 64 beyond the end of the divider extension 61, all three plies will be joined together in a unitary, integral multi-ply web by ample fiber felting at their interfaces while nevertheless maintaining substantial integrity of the fibers and other materials which may be present in the respective plies. It will thus be apparent, that the principles of the present invention are applicable to one sided drainage as demonstrated in FIG. 2, as well as the two sided drainage demonstrated in FIG. 1.

It will be understood that variations and modifications may be effected without departing from the spirit and scope of the novel concepts of this invention.

I claim as my invention:

1. For use in a machine for making a multi-ply web such as a paper from stocks having a slurry of fibers in a liquid carrier, an assembly comprising:

a headbox having a main chamber communicating with a slice chamber defined by spaced walls leading to a slice opening;

means dividing the main chamber into a plurality of separate stock subchambers;

separate stock supply means for delivering stocks which may have different physical characteristics to each of said subchambers;

at least one flexible self-positionable divider sheet in the slice chamber dividing the slice chamber into separate flow passages aligned respectively with different ones of said headbox main chamber subchambers to receive streams of the stocks from the respective subchambers and maintain the streams separated;

said flow passages leading to said slice opening for discharging the streams in contiguous substantially laminar stock jets from the slice opening into a forming zone defined between convergently co-travelling forming surfaces of the machine;

and a flexible divider extension extending from said divider sheet in free floating relation a substantial distance out of said slice opening in the direction of flow of the stock jets whereby to maintain the stock jets separated for a sufficient interval after leaving the slice opening to permit drainage and partial formation into a ply of the stock delivered by one of the stock jets onto one of the forming surfaces before the stock in a second of the stock jets joins in fiber felting multi-ply laminar relation with the contiguous surface of the partially formed ply.

2. An assembly according to claim 1:

comprising a plurality of flexible divider sheets having divider extensions extending therefrom a substantial distance out of the slice opening whereby to divide said slice chamber into three separate flow passages and whereby to divide the discharge from the slice opening into three spaced laminar stock jets.

3. An assembly according to claim 2:

wherein the divider extensions are substantially coextensive whereby to accommodate two sided drainage in the forming zone.

4. An assembly according to claim 2:

wherein said divider extensions are of different length to accommodate one sided drainage.

5. An assembly according to claim 1:

including turbulence generating means in said flow passages.

6. An assembly according to claim 5:

wherein said turbulence generating means comprise additional flexible members extending longitudinally within said flow passages.

7. In a machine for making a multi-ply web such as a paper from stocks having a slurry of fibers in a liquid carrier, and including convergently co-travelling forming surfaces defining a forming zone:

a headbox having a main chamber communicating with a slice chamber defined by spaced walls leading to a slice opening;

means dividing the main chamber into a plurality of separate stock subchambers;

separate stock supply means for delivering stocks which may have different physical characteristics to each of said subchambers;

at least one flexible self-positionable divider sheet in the slice chamber dividing the slice chamber into separate flow passages aligned respectively with different ones of said headbox main chamber subchambers to receive streams of the stocks from the respective subchambers and maintain the streams separated;

said flow passages leading to said slice opening for discharging the streams in contiguous substantially laminar stock jets from the slice opening into said forming zone defined between said forming surfaces;

and a flexible divider extension extending from said divider sheet in free floating relation a substantial distance out of said slice opening in the direction of flow of the stock jets whereby to maintain the stock jets separated for a sufficient interval after leaving the slice opening to permit drainage and partial formation into a ply of the stock delivered by one of the stock jets onto one of the forming surfaces before the stock in a second of the stock jets joins in fiber felting multi-ply laminar relation with the contiguous surface of the partially formed ply.

8. A machine according to claim 7;

wherein said forming surfaces comprise porous forming members providing two sided drainage at the forming zone.

9. A machine according to claim 8:

comprising a pair of flexible sheets dividing the slice chamber into three separate flow passages such that an intermediate stock jet is maintained separate from outer stock jets which make initial contact with the forming surfaces in the forming zone to be partially formed into plies on the forming surfaces before the intermediate jet engages in interface relation with the partially formed plies;

and flexible extensions from both of said sheets extending in free floating relation a substantial distance downstream from said slice opening whereby to divide the discharge from the slice opening into three separated laminar stock jets.

10. A machine according to claim 9:

wherein said divider sheet extensions are substantially coextensive.

11. A machine according to claim 7:

wherein one forming surface is a porous forming member, and the other of the forming surfaces is an imperforate roll, the second of the stock jets draining through the partially formed ply.

12. A device according to claim 11:

comprising a pair of the flexible divider sheets and extensions therefrom whereby to divide said slice chamber into three separate flow passages from which three separate stock jets issue through said slice opening, said extensions being of differential length for progressive development of partially formed plies starting with the ply formed from stock delivered from the stock jet nearest the porous forming surface, followed by the partial forming of the ply from the stock delivered from the intermediate of the stock jets, and finally joining of the stock delivered by the stock jet nearest the roll.

13. A method useful in a machine for making a multi-ply web such as a paper from stocks having a slurry of fibers in a liquid carrier and having a headbox provided with a main chamber communicating with a slice chamber defined by spaced walls leading to a slice opening, and which comprises:

delivering stocks which may have different physical characteristics to each of a plurality of subchambers into which the main chamber of the headbox is divided;

dividing the slice chamber into separate flow passages between a flexible self-positionable divider sheet and aligned respectively with different ones of the headbox subchambers;

receiving streams of the stock from the respective subchambers in said flow passages;

maintaining the stock streams separated in the flow passages;

discharging the streams in contiguous substantially laminar stock jets from the slice opening into a forming zone defined between convergently co-travelling forming surfaces;

and maintaining the stock jets separated between a flexible free floating extension from said divider sheet extending a substantial distance out of said slice opening in the direction of flow of the stock jets for an interval sufficient to permit drainage and partial formation into a ply of the stock delivered by one of the stock jets onto one of the forming surfaces before the stock in a second of the stock jets joins in fiber felting multi-ply laminar relation with the contiguous surface of the partially formed ply.

14. A method according to claim 13:

wherein the co-travelling forming surfaces are both porous for drainage purposes, providing a second self-positionable flexible sheet and dividing the slice chamber into a third flow passage receptive of stock from a subchamber of the headbox, discharging the stream of stock from said third flow passage as a third stock jet against the other of said forming surfaces, and interposing a free floating flexible extension between said second and third stock jets and maintaining the second of the stock jets separated from said one stock jet and said third stock jet until there has been partial deformation of ply of the stock in said one and third stock jets.

15. A method according to claim 13:

wherein said one forming surface is a porous drainage surface and the other of said forming surface is an imperforate roll, providing in the slice chamber a second flexible self-positionable sheet dividing the slice chamber into a third flow passage receiving a stream of stock from a third subchamber in the headbox, effecting drainage of the second of the stock jets through the partially formed ply from the first stock jet, interposing a free floating flexible extension between said second and third jets, maintaining the third stock jet separated from the first and second stock jets until the second stock jet has been partially formed into a ply on the first stock jet partially formed ply, and finally effecting drainage of the third stock jet downstream from said second jet stream through the partially formed first and second stock jet plies and joining all of the partially formed plies into an integral web.

16. A method according to claim 13:

comprising floating said flexible divider sheet and thereby maintaining a fine scale turbulence within the stock in the separated flow passages.

* * * * *